US009335099B2

(12) United States Patent
Garret et al.

(10) Patent No.: US 9,335,099 B2
(45) Date of Patent: May 10, 2016

(54) HEAT EXCHANGER COMPRISING A HEAT EXCHANGER BUNDLE AND A HOUSING

(75) Inventors: Paul Garret, Veneux les Sablons (FR); Philippe Faille, Reims (FR)

(73) Assignee: VALEO SYSTEMES THERMIQUES, Le Mesnil Saint Denis, Cedex (FR)

( * ) Notice: Subject to any disclaimer, the term of this patent is extended or adjusted under 35 U.S.C. 154(b) by 397 days.

(21) Appl. No.: 13/001,168

(22) PCT Filed: Jun. 22, 2009

(86) PCT No.: PCT/EP2009/057742

§ 371 (c)(1),
(2), (4) Date: Mar. 15, 2011

(87) PCT Pub. No.: WO2009/156365

PCT Pub. Date: Dec. 30, 2009

(65) Prior Publication Data

US 2011/0168366 A1 Jul. 14, 2011

(30) Foreign Application Priority Data

Jun. 26, 2008 (FR) ..... 08 03599

(51) Int. Cl.

| | |
|---|---|
| ***F28F 9/02*** | (2006.01) |
| ***F28D 9/00*** | (2006.01) |
| ***F28F 9/00*** | (2006.01) |

(Continued)

(52) U.S. Cl.

CPC ..... *F28D 9/0043* (2013.01); *F28F 9/001* (2013.01); *F28F 9/0219* (2013.01); *F28D 2021/0082* (2013.01); *F28F 2009/029* (2013.01); *F28F 2220/00* (2013.01); *F28F 2275/04* (2013.01)

(58) Field of Classification Search

CPC ..... F28F 9/0219; F28F 9/0214; F28F 2/19; F28F 9/12; F28D 7/163; F28D 9/0006; F28D 9/0043; F28D 2021/0082

USPC ..... 165/173, 149, 153, 157, 158

See application file for complete search history.

(56) References Cited

U.S. PATENT DOCUMENTS 2,615,687 A * 10/1952 Simmons ..... 165/78
2,959,400 A * 11/1960 Simpelaar ..... 165/166
4,876,778 A * 10/1989 Hagihara et al. ..... 29/890.046

(Continued)

FOREIGN PATENT DOCUMENTS

DE 19902504 A1 8/2000
DE 19927607 A1 12/2000

(Continued)

OTHER PUBLICATIONS

English language abstract for DE 19902504 extracted from the espacenet.com database on Jul. 7, 2011, 6 pages.

(Continued)

*Primary Examiner* — Tho V Duong

(74) *Attorney, Agent, or Firm* — Howard & Howard Attorneys PLLC

(57) ABSTRACT

The invention relates to a heat exchanger (10) comprising a heat-exchange core (12) and a housing (14) inside which the core (12) is housed, the core (12) comprises a stack of plates (16) and the housing (14) comprises a body in at least one first and one second portions. According to the invention, at least one of the portions is in contact with one end of each of the plates (16) of the stack of the core (12). The core (12) is brazed to the housing (14).

8 Claims, 2 Drawing Sheets

(51) Int. Cl.
*F28F 9/12* (2006.01)
*F28D 21/00* (2006.01)

(56) References Cited

U.S. PATENT DOCUMENTS

| | | | | |
|---|---|---|---|---|
| 5,048,596 | A * | 9/1991 | Lu | 165/41 |
| 5,662,162 | A * | 9/1997 | Fukuoka et al. | 165/41 |
| 2003/0010479 | A1 | 1/2003 | Hayashi et al. | |
| 2003/0196785 | A1 | 10/2003 | Knecht et al. | |
| 2004/0182546 | A1 * | 9/2004 | Yoshida et al. | 165/81 |
| 2005/0189097 | A1 | 9/2005 | Fowser et al. | |
| 2006/0048759 | A1 | 3/2006 | Hendrix et al. | |
| 2006/0048921 | A1 | 3/2006 | Usui et al. | |
| 2006/0219394 | A1 | 10/2006 | Martin et al. | |
| 2006/0278377 | A1 | 12/2006 | Martins et al. | |
| 2007/0175617 | A1 * | 8/2007 | Brost et al. | 165/149 |
| 2008/0202735 | A1 * | 8/2008 | Geskes et al. | 165/166 |
| 2010/0089548 | A1 | 4/2010 | Braic et al. | |
| 2011/0168365 | A1 | 7/2011 | Garret et al. | |
| 2011/0168366 | A1 | 7/2011 | Garret et al. | |
| 2011/0168370 | A1 | 7/2011 | Garret et al. | |

FOREIGN PATENT DOCUMENTS

| | | | |
|---|---|---|---|
| DE | 102005042908 | A1 | 4/2006 |
| DE | 102005037156 | A1 | 2/2007 |
| EP | 1348924 | A2 | 10/2003 |
| FR | 2814537 | A1 | 3/2002 |
| FR | 2855605 | A1 | 12/2004 |
| FR | 2856747 | A1 | 12/2004 |
| JP | 09089491 | | 4/1997 |
| JP | 09310996 | | 12/1997 |
| JP | 2000282963 | | 10/2000 |
| JP | 2000304486 | | 11/2000 |
| JP | 2000304486 | A * | 11/2000 |
| WO | WO 2004065874 | A1 | 8/2004 |
| WO | WO 2008125309 | A2 | 10/2008 |
| WO | WO2009156363 | A1 | 12/2009 |
| WO | WO2009156364 | A1 | 12/2009 |
| WO | WO2010003807 | A1 | 1/2010 |

OTHER PUBLICATIONS

English language abstract for DE 19927607 extracted from the espacenet.com database on Jul. 5, 2011, 9 pages.
English language abstract and equivalent for DE 102005042908 extracted from the espacenet.com database on Jul. 6, 2011, 41 pages.
English language abstract and equivalency for EP 1348924 extracted from the espacenet.com database on Jul. 5, 2011, 11 pages.
English language abstract for FR 2814537 extracted from the espacenet.com database on Jul. 7, 2011, 25 pages.
English language abstract for FR 2855605 extracted from the espacenet.com database on Jul. 6, 2011, 19 pages.
No English language abstract available for FR 2856747. However, see English language equivalency extracted from the espacenet.com database on Jul. 5, 2011, 31 pages.
English language translation for JP 09089491 extracted from the PAJ database on Jul. 6, 2011, 21 pages.
English language translation for JP 2000282963 extracted from the PAJ database on Jul. 6, 2011, 18 pages.
English language translation for JP 2000304486 extracted from the PAJ database on Jul. 5, 2011, 25 pages.
English language abstract and equivalent for WO 2004065874 extracted from the espacenet.com database on Jul. 7, 2011, 35 pages.
English language abstract and equivalent for WO 2008125309 extracted from the espacenet.com database on 7/6/201, 50 pages.
Traite de Cooperation en Matiere De Brevets International Search Report for Application No. PCT/EP2009/057739 dated Oct. 23, 2009, 6 pages.
Traite de Cooperation en Matiere De Brevets International Search Report for Application No. PCT/EP2009/057740 dated Sep. 18, 2009, 4 pages.
Traite De Cooperation en Matiere De Brevets International Search Report for Application No. PCT/EP2009/057741, dated Sep. 9, 2009, 3 pages.
Traite De Cooperation en Matiere De Brevets International Search Report for Application No. PCT/EP2009/057742 dated Sep. 18, 2009 4 pages.
English language translation for JP 09310996 extracted from the PAJ database on Jul. 6, 2011, 22 pages.

* cited by examiner

HEAT EXCHANGER COMPRISING A HEAT EXCHANGER BUNDLE AND A HOUSING

RELATED APPLICATIONS

This application claims priority to and all the advantages of International Patent Application No. PCT/EP2009/057742, filed on Jun. 22, 2009, which claims priority to French Patent Application No. FR 08/03599, filed on Jun. 26, 2008.

The invention relates to the field of heat exchangers, notably for motor vehicles.

It relates more particularly to a heat exchanger comprising a heat-exchange core and a housing comprising at least one first and one second portions and inside which the heat-exchange core is housed, in which the core comprises a stack of plates.

This type of exchanger is notably used as a cooler of air for supercharging a heat engine of a motor vehicle.

In this case, the gas to be cooled is the supercharging air (or a mixture of supercharging air and of recirculated exhaust gases). After having passed through the heat exchanger, the air is taken into the heat engine through an air distributor.

Such a heat exchanger is known notably from document DE 199 02 504. This document proposes a heat exchanger in which the supercharging air is cooled by a coolant fluid which, in this case, is a cooling liquid, that is to say water with added glycol originating from a circuit called the low-temperature circuit of a motor vehicle.

This exchanger comprises a heat-exchange core housed in a plastic housing closed by a cover.

Such an exchanger, however, has problems notably in terms of resistance to pressure.

The object of the invention is to improve the situation by proposing an exchanger which notably makes it possible to improve resistance to pressure.

Accordingly, the invention proposes a heat exchanger as described above, wherein at least one of said first or second portions is in contact with one end of each of the plates of the stack of the heat-exchange core and in which the heat-exchange core is brazed to the housing.

The fact that at least one of the portions forming the housing is in contact with one end of each of the plates of the stack of the heat-exchange core allows the heat exchanger to be more resistant to the various mechanical stresses that the heat exchanger sustains when it is used in a motor vehicle.

Such a heat exchanger also has the advantage of being easier to assemble. Specifically, it is possible to envisage with such a configuration an assembly of the heat-exchange core and of the housing in a single step.

Other advantages and features of the invention will become more evident on reading the description that is by way of illustration and is nonlimiting of examples arising from the figures in the appended drawings in which.

The invention relates to a heat exchanger 10 comprising a heat-exchange core 12 and a housing 14 inside which the heat-exchange core 12 is housed.

The heat-exchange core is made, in a manner known to those skilled in the art, by stacking of plates 16 and of corrugated inserts (not shown). The core 12 comprises an inlet and an outlet for the supercharging air.

The plates 16 can be, for example, pressed plates comprising two bosses furnished with apertures. The plates 16 are placed in pairs and the respective bosses of a plate belonging to one pair are in communication with the respective bosses of an adjacent plate belonging to an adjacent pair of plates. This makes it possible to establish a fluid communication, in this instance of the coolant liquid, between the respective pairs of plates.

Figure 1:
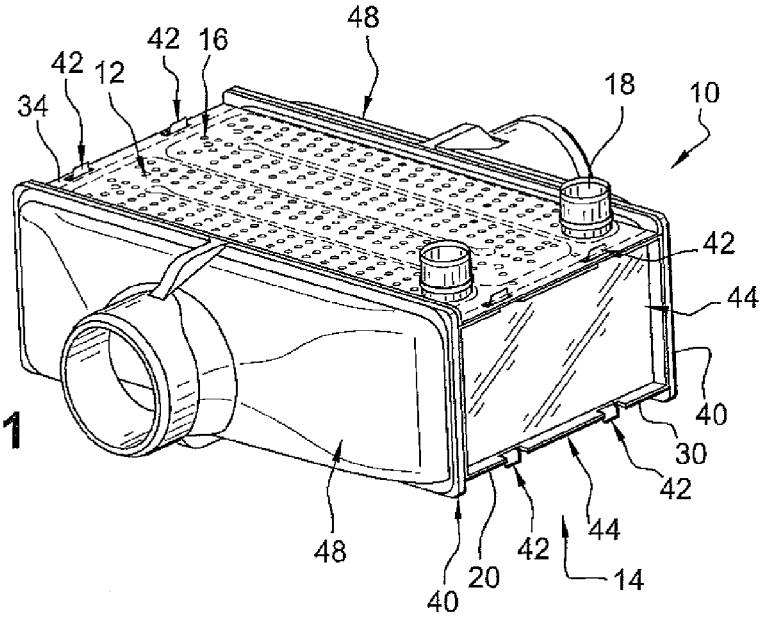
FIG. 1 represents a partially assembled view of the heat exchanger according to the present invention.

FIG. 1 represents a heat exchanger from which an upper portion of the housing has been removed in order to reveal the structure of a plate 16 of the heat-exchange core 12.

In this exemplary embodiment, the plate 16 comprises a series of first pressings, called jointed pressings, making it possible to define channels and returns for the circulation in passes of the coolant fluid. Here, the plate 16 comprises four channels and three returns making it possible to define four circulation passes for the coolant liquid.

The plate 16 also comprises a second series of pressings, more shallow than the first series of pressings described above. This second series of pressings is placed in the various circulation passes of the coolant liquid. These pressings are capable of disrupting the circulation of the coolant liquid thus improving the exchange of heat between the latter and the supercharging air.

The heat-exchange core 10 also comprises corrugated inserts (not visible in FIGS. 1 and 2) placed on each occasion between pairs of adjacent plates and brazed to the plates 16. The supercharging air circulates between each pair of plates through the corrugated inserts.

In other words, the core 12 delimits first channels for the gas to be cooled, in which the corrugated inserts are present, and second channels for the circulation of the coolant liquid. In the proposed embodiment, the coolant liquid can be engine-cooling liquid, that is to say water with added glycol, originating for example from a circuit called a low-temperature circuit of the motor vehicle.

The supercharging air is thus cooled by the cooling liquid which enters the core 12, for example, through an inlet connector nozzle 18, circulates in the second channels of the core in order to exchange heat with the supercharging air to be cooled and then leaves the core, for example, through the outlet connector nozzle 20.

The heat-exchange core 12 is housed inside a housing 14 and is brazed to the latter. In the examples shown in FIGS. 1 to 3, the housing 14 comprises a body having at least one open face. The housing 14 can be metal and notably made of aluminum or an aluminum alloy.

In the embodiments illustrated in the present application, the housings 14 comprise two open faces situated facing one another. These open faces are facing the inlet and the outlet for the supercharging air of the heat-exchange core 12.

Such a configuration allows the body to define a frame around the open face(s).

The body of the housing 14 is formed by at least one first and one second portions assembled together by brazing. In the embodiment illustrated in FIGS. 1 and 2, the body of the housing has four distinct portions 30; 32; 34 and 36 that can be seen more clearly in FIG. 2. In this exploded view of the heat exchanger, a single plate 16 of the heat-exchange core has been shown for the purposes of simplification.

Here, the four portions 30; 32; 34 and 36 are made in the form of four substantially rectangular plates.

In other words, the housing 14 has a parallelepipedal shape comprising four solid faces, namely: one face called the bottom face 36, one face called the upper face 32, two faces called side faces 30 and 34 and two open faces situated facing one another. These open faces allow the supercharging air to circulate in the heat-exchange core 12.

The housing 14 comprises two connector nozzles 18 and 20 for a coolant fluid to enter and leave the exchanger 10. The connector nozzles 18 and 20 are provided on one of said portions 30; 32; 34; 36 of the housing 14. Here, the connector nozzles 18 and 20 are situated on the upper face 32.

Here, the bottom face 36 and the upper face 32 and the two side faces 30 and 34 are respectively situated facing one another.

At least one of the portions forming the housing 14 is in contact with one end of each of the plates 16 of the stack of plates of the heat-exchange core 12.

Figure 2:
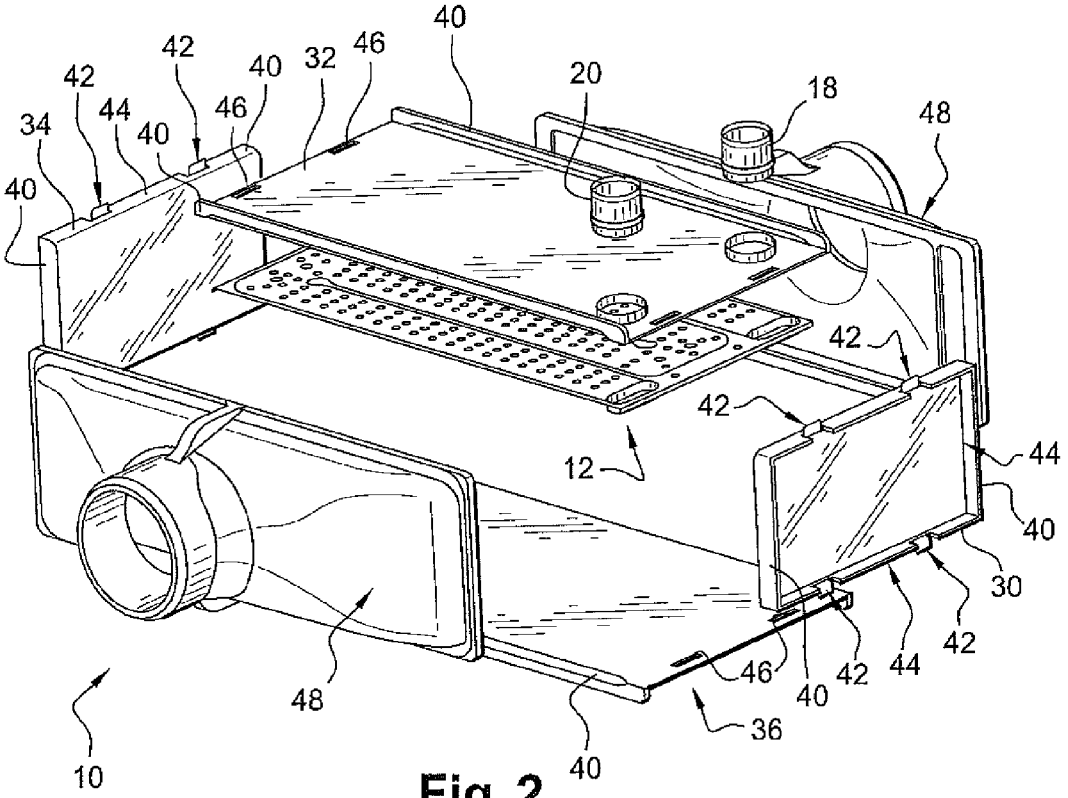
FIG. 2 represents an exploded, simplified, view of the heat exchanger according to the present invention.

The embodiment illustrated in FIGS. 1 and 2 involves a portion called a second portion which is in contact with one end of each of the plates 16, the second portion taking the form here of at least one of the side faces 30 or 34.

In other words, the first portion of the housing 14 takes the form of the upper face 32 and/or of the bottom face 36. The second portion of the housing 14, for its part, comprises at least one of the two side faces 30 or 34 or even both.

Here, the two side faces 30 and 34 are situated facing one another and on either side of the open face of the housing 14. They are both in contact with all of the plates 16 forming the stack of plates of the heat-exchange core 12, each of the side faces being in contact with one end of said plates 16.

Note that, in this embodiment, each plate 16 comprises two sides in contact, via a contact surface, respectively with each of the side faces 30 and 34 of the housing 14. Here each plate 16 is brazed over the whole of the contact surface. In other words, in this example, the brazing between a plate 16 and a side face of the housing is carried out over the whole contact surface between these two elements.

This feature notably allows the heat exchanger to be yet more resistant to the various mechanical stresses that the heat exchanger sustains when it is used in a motor vehicle and notably resistance to pressure.

When the various elements of the heat exchanger are brazed, the side faces 30 and 34 serve as an abutment for the upper portion 32. These side parts 30 and 34 also make it possible to ensure the generally parallelepipedal geometry of the housing 14 of the heat exchanger 10.

Specifically, the heat-exchange core 12 consists, as explained above, of plates 16 and inserts. At the time of the brazing, these various elements lose height because they contain at their surface a plating for brazing which melts during the brazing operation. This phenomenon of loss of height between assembled product and brazed product is also known by the name of product "bulking".

In the embodiment shown here the side faces 30 and 34 are in contact with the small sides of said plates 16. The "small sides" are the sides of the plates 16 situated facing one another, one of which comprises the bosses in this embodiment.

An embodiment not illustrated proposes that the second portion of the housing 14 should comprise a U shape and that the first portion of the housing 14 forms a cover for the second portion. In other words, it is possible to provide a housing body in two portions, namely a U-shaped portion (called the second portion) comprising one bottom face and two side faces forming the flanges of the U and one other portion, for example a flat portion, closing the volume of the second portion.

Provision is also made for the first portion of the housing 14 to have a degree of freedom relative to the second portion of the housing 14 in the direction of the stack of plates 16 of the heat-exchange core 12.

In the exemplary embodiments illustrated in FIGS. 1 and 2, this degree of freedom is obtained by the interaction of at least one tongue 42 situated on the second portion of the housing 14 with a recess or punching 46 situated on the first portion of the housing 14.

Specifically, during the brazing operation, the tongues 42 allow the bottom face 36 and the upper face 32 to slide relative to the side parts 30 and 34 and thus to accompany the loss of height of the heat-exchange core 12, this loss being, as a reminder, due to the bulking phenomenon.

The tongue 42 and the recess 46 are therefore means for mutual assembly arranged so as to manage/control the bulking of the heat exchanger 10.

Moreover, these assembly means also have the advantage of being means for self-centering of the first portion of the housing 14 on the second portion of the housing 14.

Specifically, the tongues 42 of the side faces 30 and 34 rest on the outside of the recesses 46 of the upper face 32 and of the bottom face 36. This has the advantage of not having to press laterally on the side faces 30 and 34 during the brazing. Therefore, only a vertical force is exerted on the upper face 32 and on the bottom face 36 during the brazing, which allows the housing to self-center.

The tongues 42 extend here in substantially the same direction as that of the stack of the plates of the heat-exchange core 12.

As can be more clearly seen in FIG. 2, each of the side faces 30 and 34 comprises two tongues 42 on each side of the side faces 30 and 34 in contact respectively with the upper face 32 and the bottom face 36.

In other words, in this example, each second portion of the housing 14 or, here, side face 30 or 34, comprises, on two of these sides situated facing one another, two lugs 42 capable of interacting with a recess 46 situated facing these lugs 42 on the first portion of the housing 14, or, here, upper face 32 and bottom face 36.

In the embodiment illustrated, each side face 30 and 34 also comprises at least one raised edge 44, called the first raised edge 44 or else assembly edge of the housing. The first raised edge 44 extends here substantially at right angles relative to the general extension plane of the side face on which it is formed.

This first raised edge or assembly edge of the housing 44 is formed by folding material of each side face 30 or 34.

Here, the first raised edge 44 is arranged on the portions of the side faces 30 and 34 in contact respectively with the upper face 32 and the bottom face 36.

In this embodiment, the tongues 42 are obtained by cutting and folding the first raised edge 44.

In other words, the second portion of the housing 14 comprises at least one first raised edge 44 furnished with a tongue 42 and the tongue 42 is capable of interacting with a recess 46 of the first portion. The first raised edge 44 or assembly edge of the housing therefore contributes to the assembly of the various elements of the housing 14.

Again in other words, each portion 30; 32; 34 and 36 forming the housing 14 comprises at least one assembly means 42; 46 and/or 44 capable of interacting with the adjacent portion so as to assemble the housing 14.

Therefore and by virtue of the interaction between the first raised edge 44, the tongue 42 and the recess 46, the brazing of the side faces to the upper face 32 and the bottom face 36 makes it possible to obtain an enhanced seal of the housing 14 thus reducing the risk of leakage of supercharging air.

By virtue of the configuration of the heat exchanger 10, it is possible to achieve, in a single step during the brazing operation, the assembly of all the elements comprising the heat-exchange core 12 with those comprising the housing 14.

The heat exchanger 10 may also have the feature according to which at least two contiguous portions of the body of the housing 14 comprise means for creating a bearing surface for a manifold 48. "Manifold" in this instance means both a cover and a distributor of intake air for the engine.

In the embodiment illustrated in FIGS. 1 and 2, each manifold 48 is an inlet or outlet cover for the supercharging air. These manifolds 48 are furnished respectively with a gas inlet connector nozzle and at least one gas outlet connector nozzle.

In the embodiment shown in FIGS. 1 and 2, each of the four portions 30; 32; 34 and 36 forming the housing 14 comprises means 40 for creating a bearing surface for a manifold and does so for each open face of the housing. In other words, each of the open faces of the body of the housing 14 is bordered at least partly by the means 40 for creating a bearing surface for a manifold 48.

In other words, here, the body of the housing is formed by at least two portions assembled together by brazing and at least two of said portions are designed to be contiguous and comprise means 40 for creating a bearing surface for a manifold 48.

The means 40 for creating the bearing surface for the manifold 48 therefore serve as an interface between the body of the housing 14 and the manifold(s) 48.

Here the means for creating a bearing surface are second raised edges 40 that can also be called manifold assembly edges.

Therefore, by virtue of these means 40 for creating a bearing surface for a manifold, it is no longer necessary to fit additional connecting parts to the heat-exchange core in order to form the inlet/outlet housings for the supercharging air.

The means 40 for creating a bearing surface consist, here, of raised edges 40 or manifold assembly edges 40.

The second raised edges 40 of one portion 30; 32; 34 or 36 extend substantially perpendicularly relative to the general extension plane of said portion.

In other words, in this embodiment, the portions 30; 32; 34; 36 of the body of the housing 14 each consist of a plate furnished, over at least a portion of its periphery, with means 40 for creating a bearing surface, these means consisting here of raised edges called manifold assembly edges 40.

Here, each portion 30; 32; 34 or 36 comprises at least one second raised edge in contact with the second raised edge of the contiguous portion at one of its ends so as to define the bearing surface over the whole periphery of the open face of the body of the housing. The bearing surface formed by the second raised edges 40 is flat in this case.

The purpose of this flat surface is to create a "continuous" bearing surface which will be used for the welding of a manifold or of a flange having a periphery that is also flat so as to obtain a sealed weld.

In other words, in the embodiment of FIG. 1, the second raised edge of the portion 36 (or bottom face) is in contact with both the second raised edge of the portion 30 (or side face 30) and the second raised edge of the portion 34 (or side face 34).

Similarly, the second raised edge of the portion 32 (or upper face) is in contact with both the second raised edge of the portion 30 (or side face 30) and the second raised edge of the portion 34 (or side face 34).

In other words, the frame surrounding an open face of the body of the housing 14 comprises a series of second raised edges over the whole of its periphery, each second raised edge 40 or manifold assembly edge 40 being in contact at each of its ends with another second raised edge 40.

Again in other words, the second raised edges form a border around the frame surrounding the open face of the body of the housing 14. This border serves as an interface between the housing 14 and the manifold 48.

In these examples, the second raised edges 40 are connected by a brazing seam.

The side faces 30 and 34 can therefore be seen to be plates of substantially rectangular shape comprising a periphery or perimeter bordered by two series of raised edges, these raised edges consisting of two first raised edges 44 and two second raised edges 40, each of the members of the various categories of raised edges being situated facing the member of the same category of raised edges. The function of the first raised edges 44 being to be involved in the assembly of the housing 14 and the second raised edges 40 being used for the assembly of a manifold 48 to the body of the housing 14.

In other words, at least one of the portions 30; 32; 34 or 36 of the housing 14 comprises a periphery bordered by raised edges, these raised edges consisting, in this instance, of two first raised edges 44 and of two second raised edges 40, the first raised edges 44 being involved in the assembly of the housing 14 and the second raised edges 40 being involved in the assembly of a manifold 48 to the housing 14.

Again in other words, the side faces 30 and 34 are surrounded here over the whole of their periphery with a rib formed by the first raised edges 44 and by the second raised edges 40. This rib contributes to the mechanical strength of the heat exchanger 10.

The assembly of the manifold(s) 48 to the housing 14 is carried out, for example, by welding the manifold(s) to the border formed by the second raised edges 40 around the frame surrounding the open face of the body of the housing 14.

The manifolds can, for example, be housings made of aluminum, preferably obtained by the pressure-molding process.

One embodiment of the invention also proposes that at least one of the portions 30; 32; 34 or 36 comprises local deformations capable of reducing the brazing clearances with another portion 30; 32; 34 or 36, this other portion being contiguous with the portions 30; 32; 34 or 36 comprising local deformations.

Here, each portion 30; 32; 34 and 36 comprises local deformations capable of reducing the brazing clearances between the various portions of the housing and thus improve the continuity of the flat surface forming an interface with the manifold.

According to another embodiment, the upper face 32 and the bottom face 36 have a slightly greater width than that of the plates of the heat-exchange core. In this way, the welding zone of the manifold is moved away from the brazed zones.

"Width" here means the distance separating two sides, namely from the upper face 32 or bottom face 36, or from a plate 16, in the direction of circulation of the supercharging air in the heat exchanger. In other words, in the direction of the small sides of the plates 16.

Figure 3:
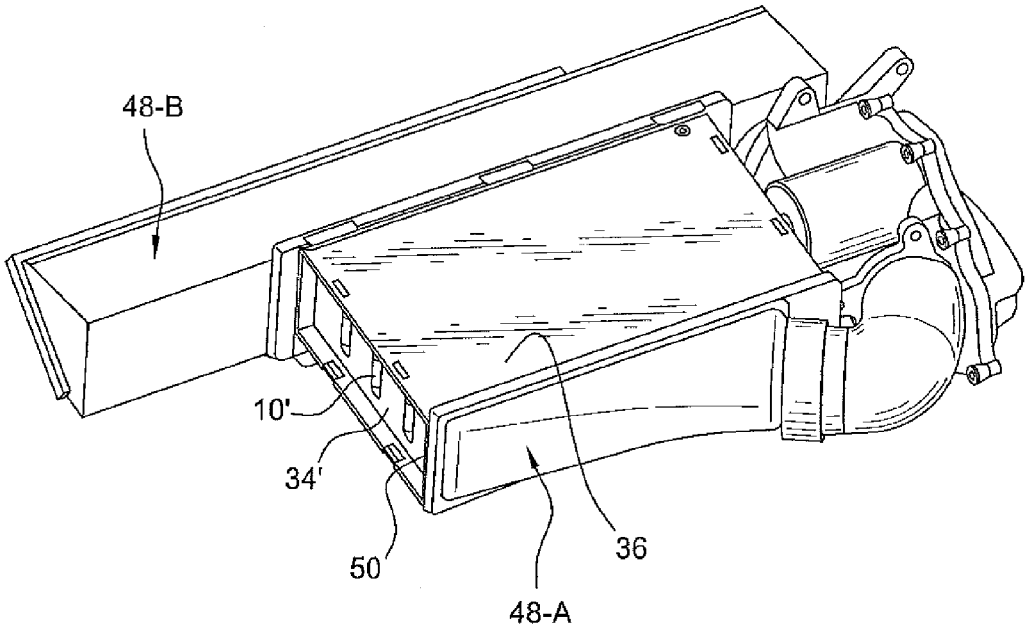
FIG. 3 represents one embodiment of the invention in which the housing for the outlet of the supercharging air is an intake-air distributor for the engine.

FIG. 3 proposes one embodiment of the invention in which the supercharging air outlet manifold is made in the form of an intake-air distributor 48-B for the engine.

An intake-air distributor for the engine allows a communication via orifices with at least one portion of the intake ducts of the engine intake chambers.

Again in other words, this distributor serves as an interface between the heat exchanger and the cylinder head of the engine on which the heat exchanger 10' is mounted.

This distributor is also known as the "intake manifold". It is attached to the cylinder head of the combustion chamber.

In this embodiment, the supercharging air inlet into the heat exchanger is via an inlet housing 48-A, the housing here takes the form of a cover. The supercharging air leaves the heat exchanger 10', for its part, via a distributor 48-B which in this instance serves as an outlet housing for the supercharging air.

The side faces 34' of the heat-exchanger housing comprises, in this embodiment, reinforcing ribs 50 which are three in number in this instance.

The invention is not limited to the embodiments described above which are described only as examples, but it covers all the variants that those skilled in the art can envisage in the context of the following claims. The variants described above may be taken separately or in combination with one another.

The invention claimed is:

1. A heat exchanger (10) comprising a heat-exchange core (12) and a housing (14) inside which the core (12) is housed, the core (12) comprising a stack of plates (16) and the housing (14) comprising a body with at least one first portion (32; 36) and one second portion (30; 34), wherein the first portion (32; 36) is in contact with one of a top and bottom of the stack of the plates (16) and the second portion (30; 34) is in contact with at least one end of each of the plates (16) of the stack of the core (12) and in that the core (12) is brazed to the housing (14), wherein, prior to brazing, the first portion (32; 36) has a degree of freedom relative to the second portion (30; 34) in the direction of the stack of the plates (16), the first portion (32; 36) and the second portion (30; 34) have solid faces such that the plates (16) do not extend through the faces and include an assembly means (42; 46) for mutual assembly arranged so as to manage/control the bulking of the heat exchanger (10), the assembly means (42; 46) includes a tongue (42) situated on one of the first or second portions (30; 32; 34; 36) and a recess (46) situated on the other portion, the tongue (42) being capable of interacting with the recess (46), wherein the second portion (30; 34) includes at least one raised edge (44) furnished with the tongue (42), wherein the tongue (42) is perpendicular to the at least one raised edge (44) and is formed from cutting and folding the raised edge (44), and at least one manifold (48) disposed perpendicular to the solid faces of at least one first portion (32; 36) and the at least one second portion (30; 34) on at least one side of the stack of plates (16) and connected to the body of the housing (14).

2. The heat exchanger (10) as claimed in claim 1, wherein the assembly means (42; 46) are also means for self-centering the first portion (32; 36) on the second portion (30; 34).

3. The heat exchanger (10) as claimed in claim 1, wherein at least one of the portions (30; 34) of the housing (14) comprises a periphery bordered by raised edges, these raised edges comprising first (44) and second (40) raised edges, the first raised edges (44) being involved in the assembly of the housing (14) and the second raised edges (40) being involved in the assembly of the manifold (48) to the housing (14).

4. The heat exchanger as claimed in claim 1, wherein the core (12) determines first channels for the circulation of a gas and second channels for the circulation of the coolant fluid.

5. The heat exchanger (10) as claimed in claim 1, wherein the housing (14) is formed by at least four portions (30; 32; 34; 36) and has at least one open face, wherein the four portions (30; 32; 34; 36) are four substantially rectangular plates.

6. The heat exchanger (10) as claimed in claim 5, wherein at least one of the portions (30; 34) of the housing (14) comprises a periphery bordered by raised edges, these raised edges comprising first (44) and second (40) raised edges, the first raised edges (44) being involved in the assembly of the housing (14) and the second raised edges (40) being involved in the assembly of the manifold (48) to the housing (14).

7. The heat exchanger (10) as claimed in claim 6, wherein the second portion (30; 34) comprises at least one raised edge (44) furnished with the tongue (42).

8. A heat exchanger (10) comprising a heat-exchange core (12) and a housing (14) inside which the core (12) is housed, the core (12) comprising a stack of plates (16) and the housing (14) comprising a body in at least one first (32; 36) and one second (30; 34) portions, wherein at least one of the first portion (32; 36) or second portion (30; 34) is in contact with one end of each of the plates (16) of the stack of the core (12) and in that the core (12) is brazed to the housing (14), wherein, prior to brazing, the first portion (32; 36) has a degree of freedom relative to the second portion (30; 34) in the direction of the stack of the plates (16), the first portion (32; 36) and the second portion (30; 34) have solid faces and include an assembly means (42; 46) for mutual assembly arranged so as to manage/control the bulking of the heat exchanger (10), the assembly means (42; 46) including a tongue (42) situated on one of the first or second portions (30; 32; 34; 36) and a recess (46) situated on the other portion, the tongue (42) being capable of interacting with the recess (46), wherein the second portion (30; 34) includes at least one raised edge (44) furnished with the tongue (42), wherein the tongue (42) is perpendicular to the at least one raised edge (44) and is formed from cutting and folding the raised edge (44); and wherein the housing (14) comprises an upper face (32) furnished with two connector nozzles (18; 20) for a coolant fluid to enter and leave the heat exchanger (10).

* * * * *